US008069505B2

(12) United States Patent
Walker

(10) Patent No.: US 8,069,505 B2
(45) Date of Patent: Dec. 6, 2011

(54) JET FOR WATER CONTAINMENT VESSELS

(75) Inventor: Victor L. Walker, Murrieta, CA (US)

(73) Assignee: Dimension One Spas, Inc., Vista, CA (US)

( * ) Notice: Subject to any disclaimer, the term of this patent is extended or adjusted under 35 U.S.C. 154(b) by 585 days.

(21) Appl. No.: 11/676,931

(22) Filed: Feb. 20, 2007

(65) Prior Publication Data

US 2008/0196153 A1 Aug. 21, 2008

(51) Int. Cl.
*A61H 33/04* (2006.01)

(52) U.S. Cl. ..... 4/541.6; 4/541.4; 4/541.1; 4/541.3; 4/541.5; 4/541.2; 24/16 R; 239/288; 239/288.5

(58) Field of Classification Search ..... 24/16 R; 4/541.1–541.6; 239/288, 288.5, DIG. 4
See application file for complete search history.

(56) References Cited

U.S. PATENT DOCUMENTS 3,865,310 A * 2/1975 Elkins et al. ..... 239/283
2007/0033725 A1* 2/2007 Holtsnider ..... 4/541.6

* cited by examiner

*Primary Examiner* — Gregory Huson
*Assistant Examiner* — Lauren Heitzer
(74) *Attorney, Agent, or Firm* — Fitch, Even, Tabin & Flannery

(57) ABSTRACT

A jet face for a jet has a plurality of detents configured to aid gripping the face for rotational operation. The jet face can also include a mounting coupling to accept a removable element. The removable element can be configured as a ring-shaped element, and the coupling a groove sized to accept the element.

26 Claims, 7 Drawing Sheets

JET FOR WATER CONTAINMENT VESSELS

TECHNICAL FIELD

The present invention relates generally to jets for water containment vessels, and more particularly, some embodiments relate to snap-fit jet faces for pools, spas, tubs, water features and other water containment vessels.

DESCRIPTION OF THE RELATED ART

Hot tubs, spas and jetted bath tubs are generally constructed in a variety of materials and methods. Initially, standalone spas were made by pool contractors and others by digging a hole in the ground and installing rebar, plumbing, electrical components and other items. The rebar was then covered with cement, gunite or other similar materials. A variety of interior finishes, including plaster, tile, and pebble coat finishes are available. The materials are very expensive and produce a product that is generally immobile. Some spas, including those integrated with swimming pools are still constructed this way.

In the early 1970s the portable hot tub or spa came into being. The first examples were made from wood which was shaped and fashioned into a circle and surrounded by bands of steel to maintain the circular shape. The installer would than wet the wood for some time, allowing the wood to expand to seal the joints to prevent leaks. At this time, due to the construction method, there were limited choices for consumers in regards to options of these hot tubs.

Newer spas with multiple jets became popular and, as a result, produced a demand for improved methods of manufacturing spas. Such methods use gel-coat and fiberglass to create a vessel to hold the water which in turn allowed for formed seating surfaces and the addition of more hydrotherapy jets. These new spas are also enclosed in a housing, or skirt, which made it possible to leave the spa sitting above ground.

These new spas with jets became popular and resulted in an improved method of manufacturing using gel-coat and fiberglass to create the vessel to hold the water and allowing for the addition of more hydrotherapy jets. Many types of jets were soon designed to offer a variety of therapy options and interchangeability and flow/volume adjustments were common features.

One challenge facing current jet designs is that of ergonomics, biomechanics and the user interface in general. Many contemporary designs are hard to adjust, repair or interchange for users. Especially when considering certain user groups with conditions that limit hand and or finger strength such as, for example, Rheumatoid Arthritis. Adding to the challenge is the spa environment which is slippery and wet with difficult light conditions when used at night. These reasons and others support the need for ergonomic/biomechanical jet designs. Current jet designs are difficult to turn and adjust. Especially over time as water minerals get built up in the parts, the jets faces become more and more difficult to turn and adjust. The jet faces typically have a round semi-smooth face with only slight indentions for user interface, called a scallop. The user has to press against these scallops to turn the jet face. These scallops do not perform well underwater nor do they consider the needs of the physically challenged user groups (like those with Arthritis, for example). Current jet designs are also static in the way of allowing the consumer to modify the jet face to increase the functionality and or aesthetics of the design. Most jet designs are also made from one material group and do not promote opportunities for user customization (e.g. anodized aluminum w/knurl, or overmolding, and so on).

BRIEF SUMMARY OF EMBODIMENTS OF THE INVENTION

Briefly, the present invention is directed toward a jet face that can be used for spa jets or jets for other water containment vessels. According to various embodiments of the invention a jet face is provided that includes a body having an outer periphery and an aperture sized to accept a nozzle; a flange about the outer periphery of the body; and a plurality of detents spaced about the periphery of the body. In one embodiment, the jet face further includes a mounting coupling disposed on the rear of the jet face configured to accept a removable shape element. In one implementation, the removable shape element is a ring and the mounting coupling is a snap groove. In another embodiment, the jet face comprises three detents, and the detents comprise concave recesses in the periphery of the face. In one embodiment, the detents are large enough to provide adequate grip by a user.

In another embodiment, a jet for a spa or other water containment vessel, includes a water inlet; a housing connected to the water inlet; and a jet face connected to the housing and including a body having an outer periphery and an aperture sized to accept a nozzle; a flange about the outer periphery of the body; and a plurality of detents spaced about the periphery of the body. In one embodiment, the jet face further includes a mounting coupling disposed on the rear of the jet face configured to accept a removable shape element. In one implementation, the removable shape element is a ring and the mounting coupling is a snap groove. In another embodiment, the jet face comprises three detents, and the detents comprise concave recesses in the periphery of the face. In one embodiment, the detents are large enough to provide adequate grip by a user.

In yet another embodiment, a water containment vessels, includes a vessel for holding water, the vessel having at least one wall having an interior surface and an exterior surface; an aperture in the wall of the vessel; and a jet mounted in the aperture and including a jet face, the jet face. In one embodiment, the jet face includes a body having an outer periphery and an aperture sized to accept a nozzle; a flange about the outer periphery of the body; and a plurality of detents spaced about the periphery of the body. In one embodiment, the jet face further includes a mounting coupling disposed on the rear of the jet face configured to accept a removable shape element. In one implementation, the removable shape element is a ring and the mounting coupling is a snap groove. In another embodiment, the jet face comprises three detents, and the detents comprise concave recesses in the periphery of the face. In one embodiment, the detents are large enough to provide adequate grip by a user.

Other features and aspects of the invention will become apparent from the following detailed description, taken in conjunction with the accompanying drawings, which illustrate, by way of example, the features in accordance with embodiments of the invention. The summary is not intended to limit the scope of the invention, which is defined solely by the claims attached hereto.

BRIEF DESCRIPTION OF THE DRAWINGS

The present invention, in accordance with one or more various embodiments, is described in detail with reference to the following figures. The drawings are provided for purposes of illustration only and merely depict typical or example embodiments of the invention. These drawings are provided to facilitate the reader's understanding of the invention and shall not be considered limiting of the breadth, scope, or applicability of the invention. It should be noted that for clarity and ease of illustration these drawings are not necessarily made to scale.

Some of the figures included herein illustrate various embodiments of the invention from different viewing angles. Although the accompanying descriptive text may refer to such views as "top," "bottom" or "side" views, such references are merely descriptive and do not imply or require that the invention be implemented or used in a particular spatial orientation unless explicitly stated otherwise.

Figure 2:
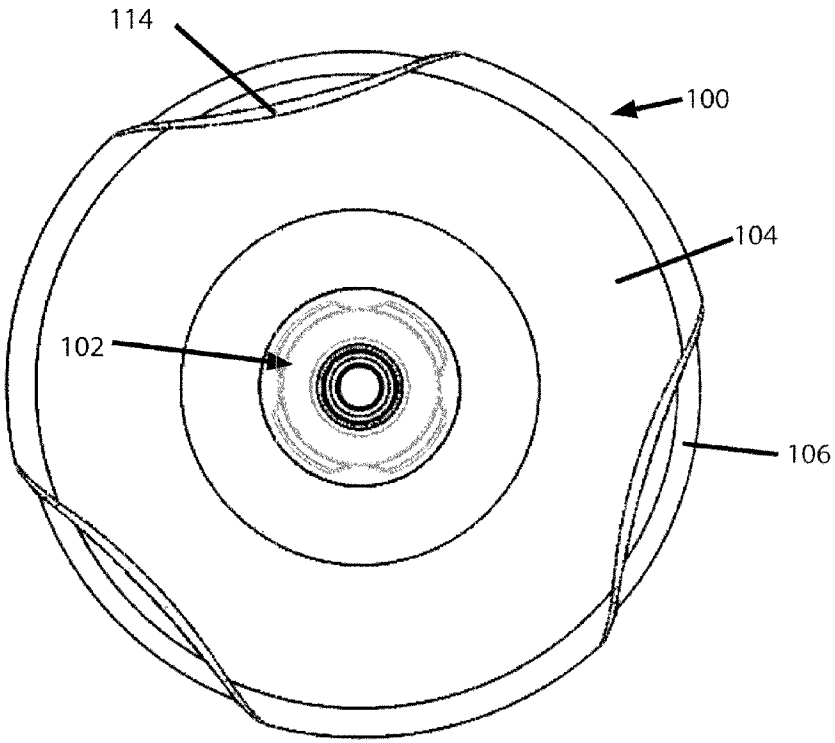
FIG. 2 is a diagram illustrating a top view of a spa jet with the snap jet face in accordance with one embodiment of the invention.

The figures are not intended to be exhaustive or to limit the invention to the precise form disclosed. It should be understood that the invention can be practiced with modification and alteration, and that the invention be limited only by the claims and the equivalents thereof.

DETAILED DESCRIPTION OF THE EMBODIMENTS OF THE INVENTION

The present invention is directed toward a flexible jet system and method for water containment vessels such as pools, spas, tubs, fountains, water features and other water containment vessels. Before describing the invention in detail, it is useful to describe an example environment with which the invention can be implemented. One such example is that of a pool, spa or other water containment vessel. From time-to-time, the present invention is described herein in terms of application in the particular example environment of a spa. Description in terms of this spa environment is provided to allow the various features and embodiments of the invention to be portrayed in the context of an exemplary application. After reading this description, however, it will become apparent to one of ordinary skill in the art how the invention can be implemented in different and alternative environments, including other water containment vessels and other applications where adjustable jets may be desirable.

The present invention is directed toward a new jet face configuration. In one embodiment, the jet face provides a platform about which many design iterations can be developed easily and cost effectively. Providing a platform for many design iterations can provide the opportunity to design platform-based products for unique needs such as, for example, providing the ability to adjust the jet face to users having lower levels of hand and arm strength. A customized platform can also allow the manufacture to offer several levels of design and functionality for customers while managing tooling, handling and storage costs.

In one embodiment, the jet face system is comprised of two main components. The first component is the jet face itself, which can be provided in a number of shapes and configurations. Preferably, shapes and configurations are chosen to improve the ability of a user to turn or adjust the jet face. The second component is a ring or other shape that can be included to provide additional options of configurability. In one embodiment, the second component is configured to be removably installed with a jet face. For example, in one embodiment, the ring snaps into a snap-fit part of the jet face. The jet face can be used with or without the ring or shape snapped into it.

In one embodiment, the jet face is formed roughly in the shape of a softened triangle designed to provide an ergonomic/biomechanic user interface. Such a shape can help users with low hand/arm strength grip and adjust the jet face. In one embodiment, the triangular shape is achieved by providing detents (for example three detents) in the rounded circumference of the jet face. In one embodiment, the detents are formed as concave cutaways, each of about 12% to 30% of the jet face's periphery, although other proportions are possible. In another embodiment, the detents consume the entire periphery of the face.

The detents or fingers, ease the use of the jet face and promote easy adjustment for the user. Such an embodiment can be beneficial in special conditions of water containment vessels, especially spas and hot tubs, where jet faces are often adjusted underwater, in the dark and under turbulent conditions. Providing detents or other ergonomic mechanisms can facilitate the turning of the face. For example, with a design including a plurality of detents, the jet face can be turned by gripping the plastic detents or fingers, and using the side of the plastic finger for leverage.

Figure 1:
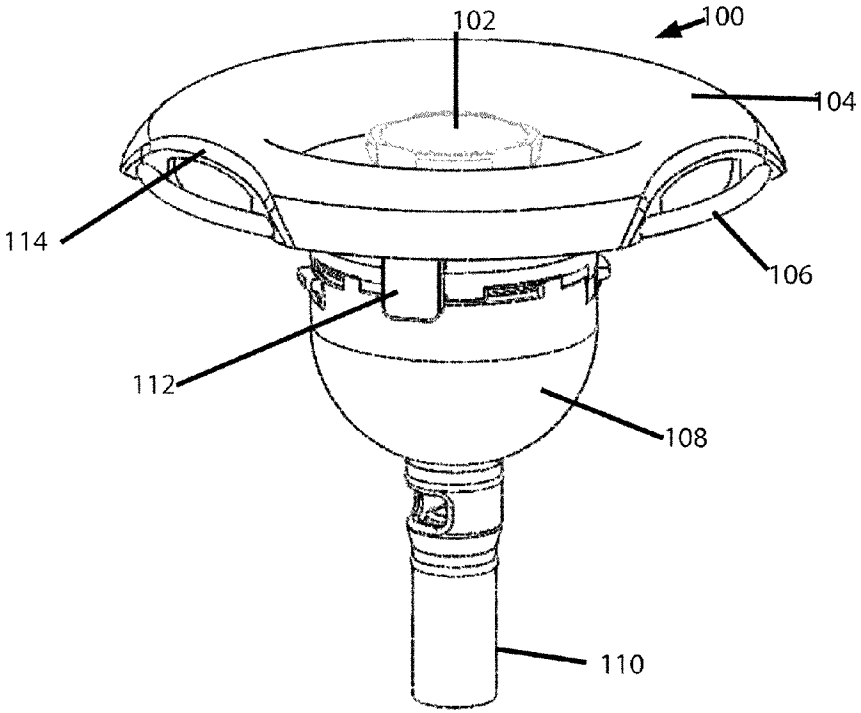
FIG. 1 is a diagram illustrating a jet nozzle with a jet face in accordance with one embodiment of the invention.

FIG. 1 is a diagram illustrating a jet nozzle with a jet face in accordance with one embodiment of the invention. Referring now to FIG. 1, spa jet 100 includes a nozzle 102, a jet face 104, a housing 108, and a water inlet 110. In the illustrated example, the jet face 104 includes, a snap ring 106, detents 114 located about the periphery of the body of face 104, and tabs 112. In operation, as with conventional jets, pressurized water is fed through inlet 110, into housing 108 and out of nozzle 102. Nozzle 102 can be configured to extent through an aperture in face 104. The pressurized water is usually fed with sufficient pressure or force to provide hydrotherapy or massaging action by the water. Rotation of the flange for jet face 104 can be done to adjust the operation of jet 100, such as, for example, to adjust the speed, pressure or direction of the water exiting from nozzle 102, or to shut off the flow of water. In one embodiment, jet face 104 is removably mounted to housing 108 so that it can be replaced with relative ease. Tabs 112 can be included to provide removable mounting as well as to control the operation of the jet.

As shown in the illustrated example, jet face 104 includes a plurality of detents 114 that can be used to facilitate gripping and rotation of jet face 104. In the illustrated embodiment, two detents 114 can be seen. As the example demonstrates, any number of detents can be provided with jet face 104. Their number, shape and size can be chosen based ergonomics, biomechanics, desired operational characteristics or for aesthetic reasons.

Also illustrated in the example of FIG. 1 is a removable element 106 that is removably mounted in a mounting coupling. Particularly, in the example illustrated in FIG. 1, a snap ring 106 is snapped (or otherwise inserted, placed or installed) into a groove about the rear periphery of jet face 104 (for example, a snap groove 118 illustrated in FIG. 3). When used with a ring or other shape in the snap fit feature, the jet face 104 can take on a different form. Indeed, different configurations of shapes 106 snapped into the groove or otherwise fixed to the face 104 can provide different looks or feel to the spa jet 100. For example the ring or element 106 can be made in many different shapes, sizes and designs, and made from many different materials that enhance a tactile as well as aesthetic qualities of the jet 100.

For example, ring 106 can be made from stainless steel to add reflectivity and accents to the spa design. Thus, in such an embodiment, a chrome look can be added to the spa without sacrificing the user interface on the jet face itself. Ring 106 can also be molded in plastic with a finger detent to add even more tactile areas for the user. Finger detents on the ring or other shape add another level of tactile interface to the design and can promote ease of adjustment of the jet face for the user. In addition to detents, ridges, protuberances, or other shape features can be provided to increase the tactile response of ring 106. Ring 106 can also be over-molded (for example, over ABS) with a rubber or rubber-like materials such as, for example, Kraton or Viton. The rubber ring can then snap into the back of the jet face as illustrated. Providing rubber or rubber-like surface on the ring also can promote an enhanced user interface at the finer detents 114 in the jet face 104. This can be accomplished as rubber or other like materials tend to be less slippery than plastic or stainless steel.

Figure 13:
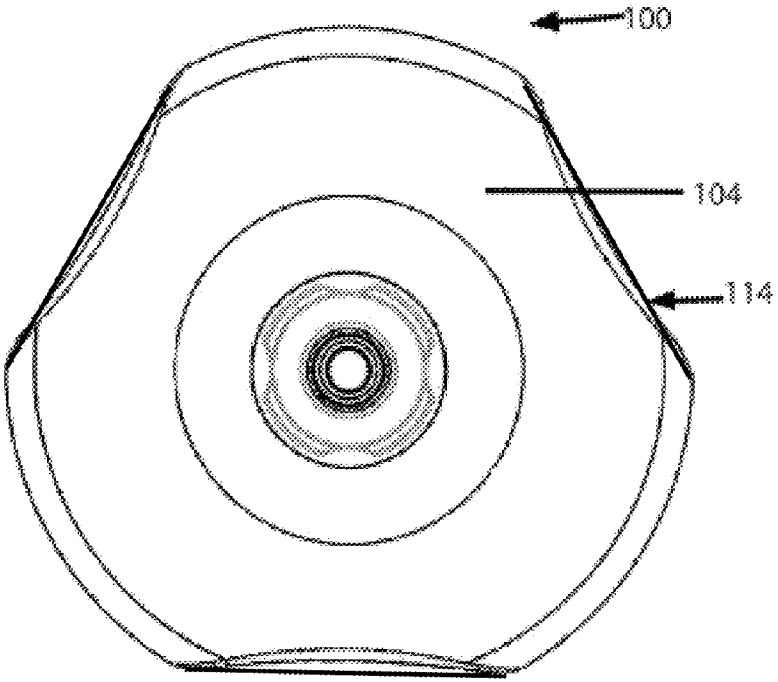
FIG. 13 is a diagram illustrating a top view of a iet having relatively straight detents.

FIG. 2 is a diagram illustrating a top view of a spa jet with the nap jet face in accordance with one embodiment of the invention. Jet face 104 can be molded, cast or otherwise fashioned in the desired shape. Referring now to FIG. 2, illustrated in this example are is a jet face 104 having an approximately triangular shape with smooth angles. Particularly, in the illustrated example, three detents 114 are illustrated as being "cut" or otherwise formed into the otherwise circular circumference of jet face 104. As illustrated, in one embodiment, the detents can be rounded themselves, having somewhat of a concave surface in the illustrated example. As this example illustrates, detents can also be relative straight (as shown in FIG. 13) or convex, however, the concave shape of the detents provides increased gripping ability. Also, although three detents are illustrated, any number of detents can be provided for either aesthetic or functional reasons.

In the illustrated embodiment, the detents share an approximately equal portion of the periphery of the jet face 104 with the non-detent areas. That is, each of the three detents is illustrated as spanning approximately 60 degrees, or $1/6^{th}$ the circumference of the face (about 16.667%). However, as would be apparent to one of ordinary skill in the art after reading this description, other proportions can be utilized to provide appropriate gripping surfaces.

Figure 3:
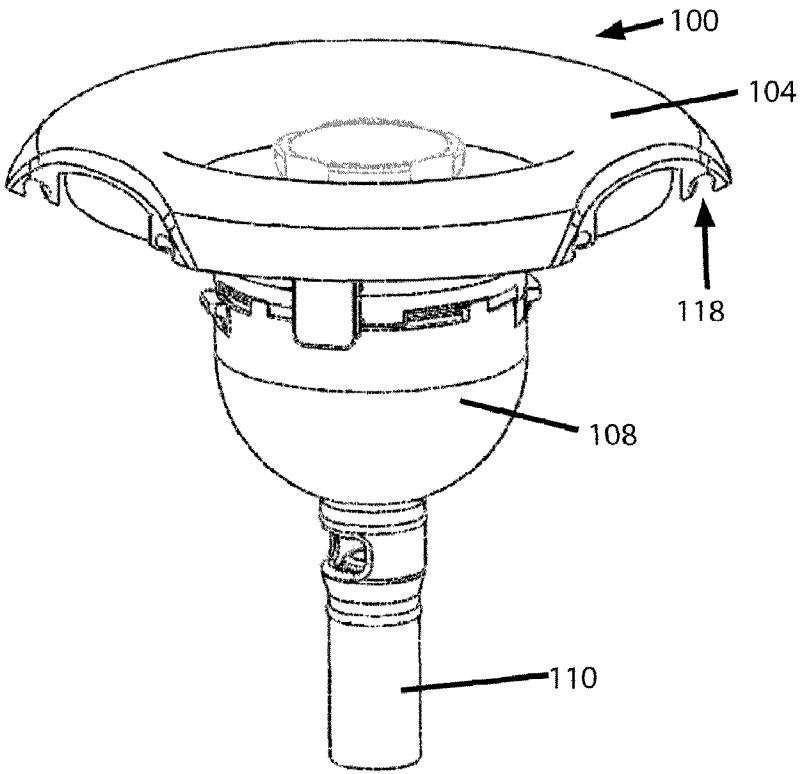
FIG. 3 is a diagram illustrating an example of a spa jet 100 having a jet face without ring or shape 106, in accordance with one embodiment of the invention.

As stated above, spa jet 100 can also be utilized without ring or shape 106 in place. FIG. 3 is a diagram illustrating an example of a spa jet 100 having a jet face 104 without a ring or element 106, in accordance with one embodiment of the invention. Referring now to FIG. 3, the spa jet includes jet face 104, housing 108, and inlet 110, similar to the example illustrated in FIGS. 1 and 2. However, this example illustrates a jet 100 without a ring or other snap element 106 attached into a snap groove 118. Although it is not necessary to provide a snap groove in embodiments where a ring or other shapes is not intended to be utilized, a snap groove 118 can be provided for a variety of reasons such as, for example, to reduce tooling costs (where many faces 104 are manufactured for use with and without rings) or to provide customizability or upgradeability such as to allow rings 106 to be added at a later time.

Figure 4:
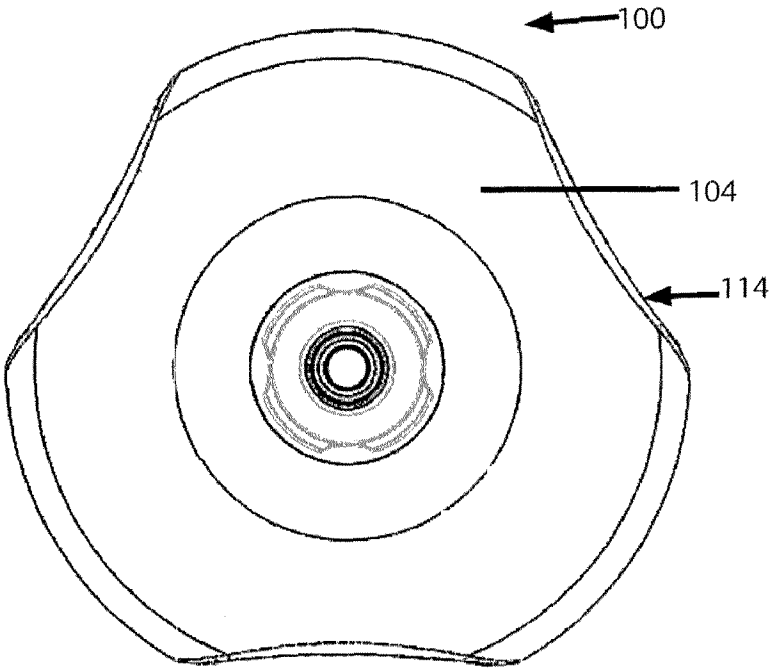
FIG. 4 is a diagram illustrating a top view of a jet without a snap ring in accordance with one embodiment of the invention.

FIG. 4 is a diagram illustrating a top view of a jet 100 without a snap ring. Referring now to FIG. 4, much like the embodiment illustrated in FIG. 2, the example spa jet 100 includes three detents 114 without the periphery of jet face 104. FIG. 4 provides an example of how the spa jet 100 of FIG. 2 would appear without ring 106 in place.

Figure 5:
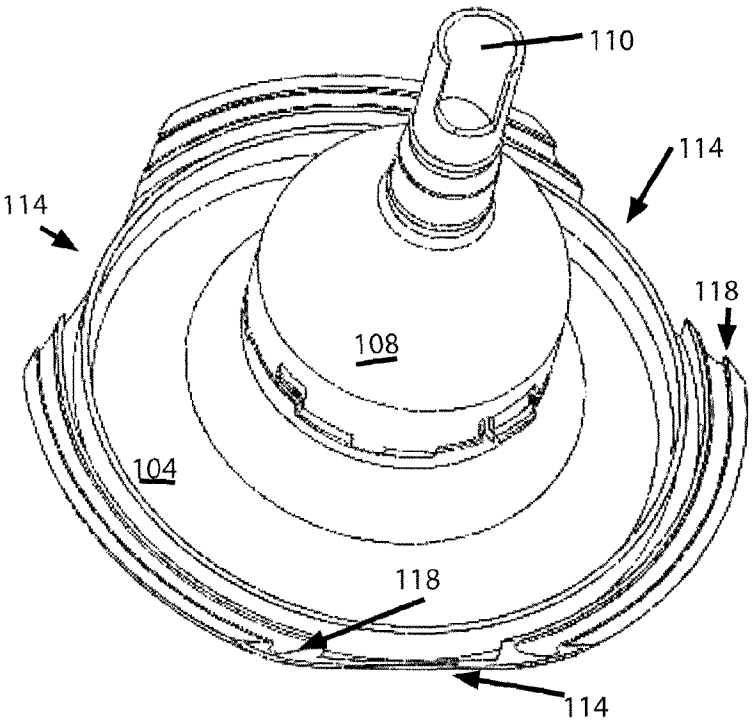
FIG. 5 is a diagram illustrating a rear view of a spa jet in accordance with one embodiment of the invention.

FIG. 5 is a diagram illustrating a rear view of a spa jet 100 in accordance with one embodiment of the invention. Referring now to FIG. 5, spa jet 100, in the illustrated example includes a jet face 104 mated to a housing 108, which in turn is attached to a water inlet 110. In the illustrated example, three detents 114 are provided in face 104. Additionally, this diagram illustrates a snap groove 118 on the periphery of jet face 104. As discussed above, snap groove 118 allows for the insertion and removal of a ring 106.

Figure 6:
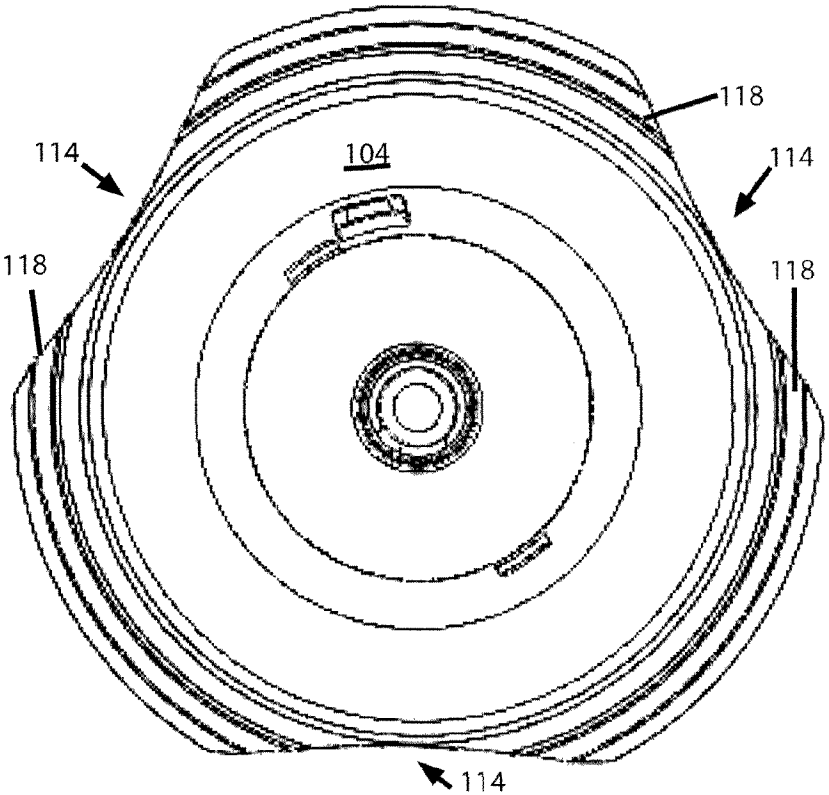
FIG. 6 is a diagram illustrating a top-down view of the bottom of a jet face in accordance with one embodiment of the invention.

FIG. 6 is a diagram illustrating a top-down view of the bottom of a jet face in accordance with one embodiment of the invention. Referring now to FIG. 6, this view also illustrates jet face 104 attached to a housing 108, and including three detents 114 and a snap groove 118.

Figure 7:
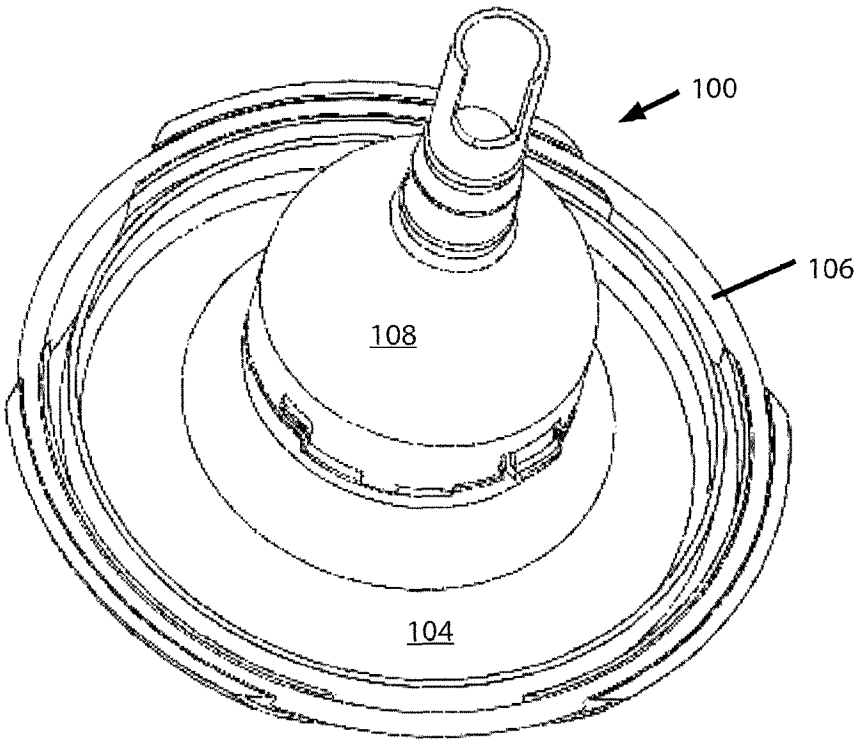
FIG. 7 is a diagram illustrating a perspective view of a spa jet including a snap ring in accordance with one embodiment of the invention.

FIG. 7 is a diagram illustrating a perspective view of a spa jet 100 including a snap ring 106 in accordance with one embodiment of the invention. Referring now to FIG. 7, this embodiment is similar to that of FIG. 5 with housing 108, jet face 104, detents 114 and a snap groove 118. However, also illustrated in FIG. 7 is a snap ring 106 inserted in snap groove 118. For clarity of illustration, detents 114 and snap groove 118 are not labeled in FIG. 7, however, in this embodiment, these elements can be the same as or similar to those shown in FIG. 5 and FIG. 7.

Figure 8:
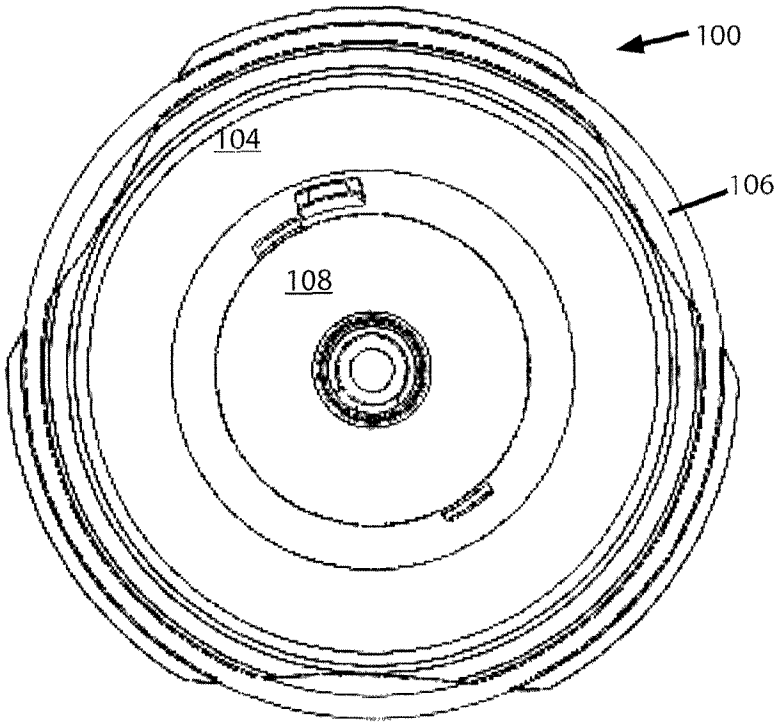
FIG. 8 is a diagram illustrating a top-down view of a jet face with a snap ring in accordance with one embodiment of the invention.

FIG. 8 is a diagram illustrating a top-down view of a jet face with a snap ring in accordance with one embodiment of the invention. As discussed above with FIG. 5 and FIG. 7, FIG. 8 illustrates the embodiment depicted in FIG. 6 but with the inclusion of a snap ring 106 in snap groove 118.

Figure 10:
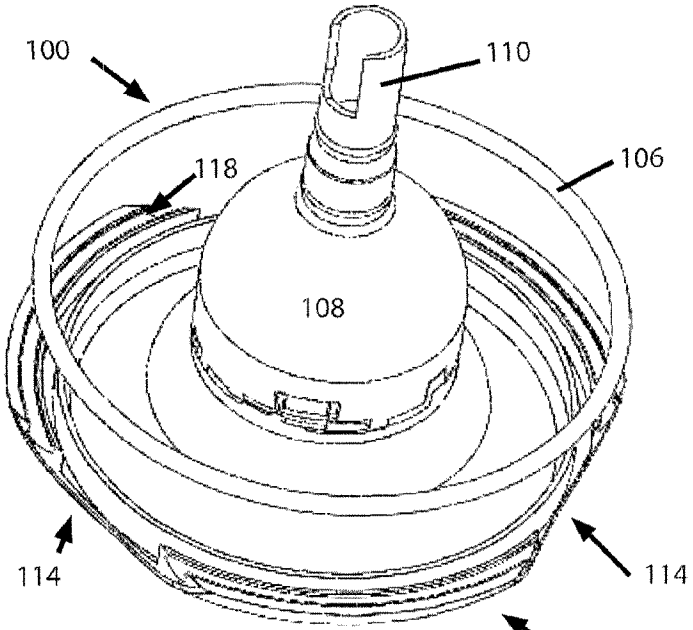
FIG. 10 provides a perspective of an exploded view of the rear of the example spa jet with a snap ring in accordance with one embodiment of the invention.
Figure 9:
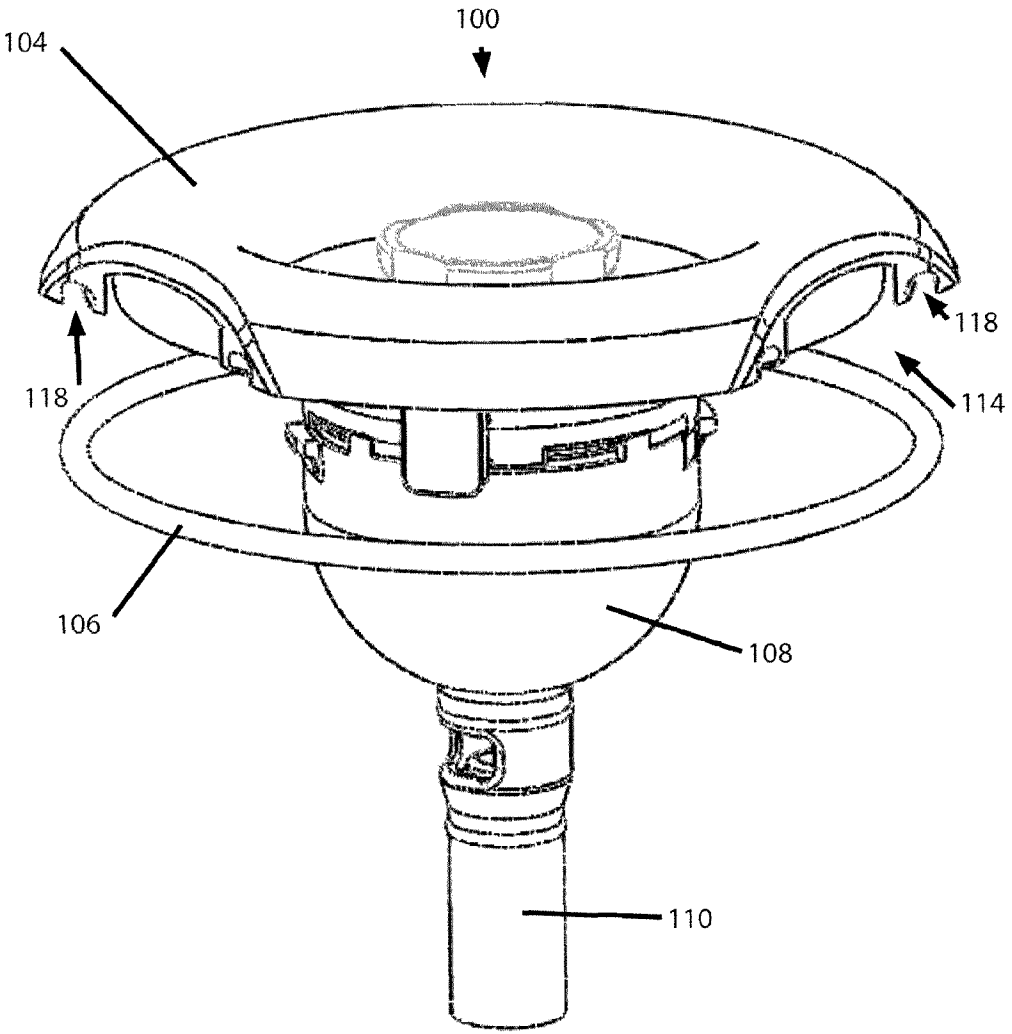
FIG. 9 provides a side perspective of an exploded view of a spa jet with a snap ring in accordance with one embodiment of the invention.

FIG. 9 and FIG. 10 provide an exploded view of a spa jet 100 with a snap ring. FIG. 9 provides a side perspective view while FIG. 10 provides a top-down perspective view of the rear of the example spa jet 100. Referring now to FIG. 9 and FIG. 10, snap ring 106 in this example is a circular ring sized to snap into snap groove 118. In one embodiment, snap ring 106 can be inserted into and removed from snap groove 118 to facilitate interchangeability of snap rings 106. Additionally, as discussed above, spa jet 100 can be used without snap ring 106 in place.

Figure 11:
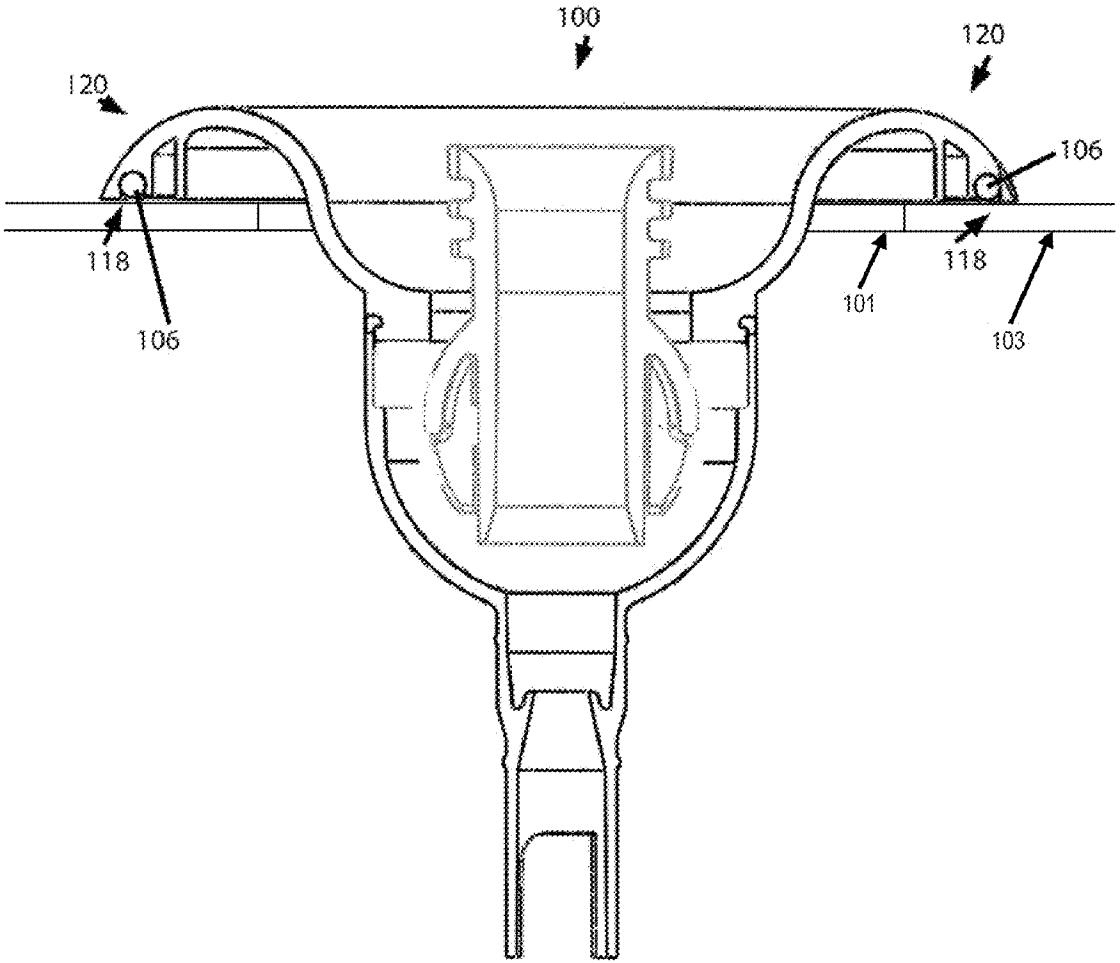
FIG. 11 is a cutaway view of a spa jet mounted in an aperture in a wall of a vessel for holding water in accordance with one embodiment of the invention.

FIG. 11 is a cutaway view of a spa jet 100 in accordance with one embodiment of the invention. Referring now to FIG. 11, snap ring 106 can be seen as inserted in snap groove 118 of the spa jet 100. As illustrated in FIG. 11, in this embodiment, jet face 104 also includes a flange 120. A flange can be provided as a projecting rim, collar or other structure and can be used to provide additional strength of stiffness for supporting area to the jet face 104. The spa jet 100 is mounted in an aperture 101 of a wall 103 of a vessel for holding water.

Figure 12:
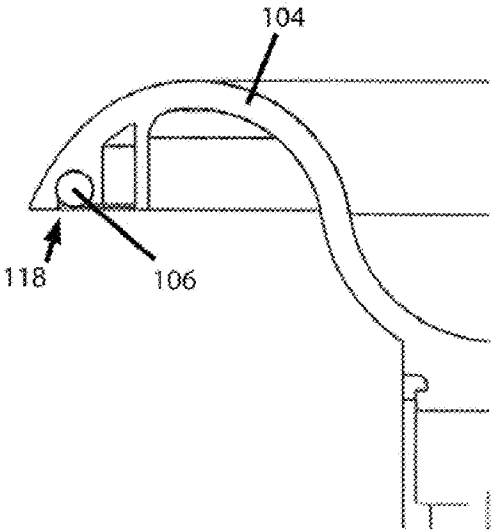
FIG. 12 is a diagram illustrating a close-up cross section view of a snap ring in a snap groove in accordance with one embodiment of the invention.

FIG. 12 is a diagram illustrating a close-up cross-sectional view of a snap ring 106 in a snap groove 118 in accordance with one embodiment of the invention. Referring now to FIG. 12, the diagram illustrates snap ring 106 inserted into snap groove 118 in the flange area of jet face 104.

As the above examples illustrate, a variety of shapes, sizes and configurations for the jet face 104 and ring shape 106 can be implemented to provide advantages over traditional jet face designs. Designs can be chosen to allow many options, including options for the physically challenged. Additionally, with the ability to provide removable and interchangeable jet faces 104 as well as interchangeable jet rings or elements 106, a customizable look and feel of a spa can be accomplished. Customizing can be done, for example, by manufacturers as well as after-market providers and end users.

In one embodiment, the jet face can be manufactured in extra large footprint making it easier to use for a wide range of users. Additionally, more ergonomic configurations such as, for example, the triangular shape illustrated in various of the drawings, helps to increase tactile angles and functionality for users with low hand or arm strength conditions.

As stated above, using a modular or platform-based design can allow manufacturers (either OEMs or after market) to offer design variations while keeping tooling and parts requirements to a minimum.

The snap in ring 106 can be made from a variety of materials, including, but not limited to, plastic, stainless steel, anodized aluminum, over molded plastic, rubber, and so on. Finger detents, protuberances or other shapes can be provided on the ring 106 to promote a higher level of tactile engagement and leverage for the user. Also, jet face 104 can be provided in a wide range of shapes and sizes and, color and material variations can be provided for aesthetic or functional purposes.

While various embodiments of the present invention have been described above, it should be understood that they have been presented by way of example only, and not of limitation. Likewise, the various diagrams may depict an example configuration for the invention, which is done to aid in understanding the features and functionality that can be included in the invention. The invention is not restricted to the illustrated examples configurations, but the desired features can be implemented using a variety of alternative configurations.

Although the invention is described above in terms of various exemplary embodiments, implementations, and applications, it should be understood that the various features, aspects and functionality described in one or more of the individual embodiments are not limited in their applicability to the particular embodiment with which they are described, but instead can be applied, alone or in various combinations, to one or more of the other embodiments of the invention, whether or not such embodiments are described and whether or not such features are presented as being a part of a described embodiment. Thus the breadth and scope of the present invention should not be limited by any of the above-described exemplary embodiments.

Terms and phrases used in this document, and variations thereof, unless otherwise expressly stated, should be construed as open ended as opposed to limiting. As examples of the foregoing: the term "including" should be read as mean "including, without limitation" or the like; the term "example" is used to provide exemplary instances of the item in discussion, not an exhaustive or limiting list thereof; "a" or "an" means "at least one" or "one or more" and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

A group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although items, elements or components of the invention may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent.

Additionally, the various embodiments set forth herein are described in terms of exemplary diagrams. As will become apparent to one of ordinary skill in the art after reading this document, the illustrated embodiments and their various alternatives can be implemented without confinement to the illustrated examples.

The invention claimed is:

1. A jet face, comprising:

a body having an outer periphery edge defining a footprint of the body, an aperture sized to accept a nozzle, and a span of the body extending between the outer periphery edge and the aperture; and a plurality of detents encompassing or interrupting the outer periphery edge, extending radially inward toward the aperture and spaced about the outer periphery edge of the body.

2. A jet face, comprising:

a body having an outer periphery edge defining a footprint of the body, an aperture sized to accept a nozzle, and a span of the body extending between the outer periphery edge and the aperture;

a plurality of detents extending radially inward toward the aperture and spaced about the periphery edge of the body; and further comprising a shape element removably mounted using a mounting coupling disposed on the rear of the jet face, the shape element being covered by the span of the body between the detents and projecting radially outward from the outer periphery edge of the body at the detents.

3. The jet face of claim 2, wherein the removable shape element is a ring.

4. The jet face of claim 2, wherein the mounting coupling is a snap groove.

5. The jet face of claim 1, wherein the jet face comprises three detents such that the footprint defined by the outer periphery edge of the body is in the shape of a softened triangle.

6. The jet face of claim 1, wherein the detents comprise concave recesses in the periphery of the face.

7. A spa jet, comprising:

a water inlet;

a housing connected to the water inlet; and a jet face connected to the housing and comprising:

a body having an outer periphery edge defining a footprint of the body, an aperture sized to accept a nozzle, and a span of the body extending between the outer periphery edge and the aperture; and a plurality of detents encompassing or interrupting the outer periphery edge, extending radially inward toward the aperture and spaced about the periphery edge of the body.

8. A spa jet, comprising:

a water inlet;

a housing connected to the water inlet; and a jet face connected to the housing and comprising:

a body having an outer periphery edge defining a footprint of the body, an aperture sized to accept a nozzle, and a span of the body extending between the outer periphery edge and the aperture; and a plurality of detents extending radially inward toward the aperture and spaced about the periphery edge of the body;

wherein the jet face further comprises a shape element removably mounted using a mounting coupling disposed on the rear of the jet face, the shape element being covered by the span of the body between the detents and projecting radially outward from the outer periphery edge of the body at the detents.

9. The jet of claim 8, wherein the removable shape element is a ring.

10. The jet of claim 8, wherein the mounting coupling is a snap groove.

11. The jet of claim 7, wherein the jet face comprises three detents.

12. The jet of claim 7, wherein the detents comprise concave recesses in the periphery of the face.

13. The apparatus of claim 7, in combination with a vessel for holding water, the vessel having an interior surface and an aperture in the wall of the vessel, wherein the spa jet is mounted in the aperture of the wall with the jet face disposed substantially on an inwardly facing side of the interior surface.

14. The apparatus of claim 13, wherein the vessel is a pool, spa, fountain, or tub.

15. A jet face suitable for use with a spa, the jet face comprising a body having an outer periphery edge, an aperture having a longitudinally-extending central axis, and a span positioned between the outer periphery edge and the aperture, the outer periphery edge having a plurality of arcuate segments encompassing or interrupting the outer periphery edge and disposed radially outward in a direction perpendicular to the axis of the aperture, the arcuate segments each being spaced from each other by one or more detents having a portion positioned radially inward in a direction perpendicular to the axis of the aperture.

16. The jet face of claim 15, wherein the arcuate segments each have a constant radius in a direction perpendicular to the axis of the aperture.

17. The jet face of claim 15, wherein the detents are inwardly concave in a direction perpendicular to the axis of the aperture.

18. The jet face of claim 15, wherein the detents are relatively straight.

19. A jet face suitable for use with a spa, the jet face comprising a body having an outer periphery edge, an aperture having a longitudinally-extending central axis, and a span positioned between the outer periphery edge and the aperture, the outer periphery edge having a plurality of arcuate segments disposed radially outward in a direction perpendicular to the axis of the aperture, the arcuate segments each being spaced from each other by one or more detents having a portion positioned radially inward in a direction perpendicular to the axis of the aperture, wherein the jet face has an outwardly facing portion and an opposite underside, the underside having an attached shape element which lies beneath the body at locations inwardly adjacent to the arcuate segments and projects outwardly from beneath the outer periphery edge at locations coinciding with the detents when the jet face is viewed from its outwardly facing portion perpendicular to the axis of the aperture.

20. The jet face of claim 19, wherein the underside of the body at locations inwardly adjacent to the arcuate segments each have a snap groove for permitting removable attachment of the shape element.

21. The jet face of claim 20, wherein a depending circular flange depends from the underside of the body of the jet face, the flange being disposed radially inward from a minimum radial of the detents as measured along a radius perpendicular to the axis of the aperture.

22. The jet face of claim 21, wherein the snap grooves are disposed radially outward from the flange.

23. The jet face of claim 15, wherein each detent extends between about 12% and 30% of the outer periphery edge of the body.

24. The jet face of claim 15, wherein three arcuate segments and three detents are positioned about the outer periphery edge of the body such that the jet face is in the shape of a softened triangle.

25. The jet face of claim 24, wherein each of the three detents spans approximately 60 degrees.

26. The jet face of claim 19 wherein the shape element is a ring.

* * * * *